US011850559B2

(12) United States Patent
Wilder

(10) Patent No.: US 11,850,559 B2
(45) Date of Patent: Dec. 26, 2023

(54) APPARATUS AND METHOD FOR MULTIPURPOSE WINE PREPARATION DEVICE

(71) Applicant: Andrew Wilder, Newberg, OR (US)

(72) Inventor: Andrew Wilder, Newberg, OR (US)

( * ) Notice: Subject to any disclaimer, the term of this patent is extended or adjusted under 35 U.S.C. 154(b) by 0 days.

(21) Appl. No.: 17/966,204

(22) Filed: Oct. 14, 2022

(65) Prior Publication Data

US 2023/0124978 A1 Apr. 20, 2023

Related U.S. Application Data

(60) Provisional application No. 63/255,582, filed on Oct. 14, 2021.

(51) Int. Cl.

| | |
|---|---|
| ***B01F 23/2361*** | (2022.01) |
| ***B01F 33/501*** | (2022.01) |
| ***B65D 23/04*** | (2006.01) |
| *B01F 101/17* | (2022.01) |
| *B65D 25/48* | (2006.01) |

(52) U.S. Cl.

CPC ..... *B01F 23/2361* (2022.01); *B01F 33/5011* (2022.01); *B65D 23/04* (2013.01); *B01F 2101/17* (2022.01); *B65D 25/48* (2013.01)

(58) Field of Classification Search

CPC .. B01F 23/2361; B01F 23/236; B01F 23/214; B01F 23/23; B01F 25/43231; B01F 25/4323; B01F 2101/17; B65D 1/023; B65D 23/04; B65D 25/48; B65D 39/14

USPC ..... 99/277.1, 323.1

See application file for complete search history.

(56) References Cited

U.S. PATENT DOCUMENTS

| | | | | |
|---|---|---|---|---|
| 3,235,133 | A * | 2/1966 | Zimmerman | B65D 47/06 222/189.06 |
| 3,966,099 | A * | 6/1976 | Sanford, Jr. | B67D 3/0051 222/567 |
| 9,033,187 | B2 * | 5/2015 | Luebke | B01F 23/232 99/323.1 |
| 9,399,197 | B2 * | 7/2016 | Graham | B65D 47/06 |

(Continued)

*Primary Examiner* — Reginald Alexander

(74) *Attorney, Agent, or Firm* — Mohr Intellectual Property Law Solutions, PC

(57) ABSTRACT

A system and method for a multipurpose wine preparation device to facilitate pouring a wine from a wine bottle is provided. The body of the multipurpose wine preparation device has an inlet portion and an outlet portion. The inlet portion is configured to slidably engage into an opening of the wine bottle. The inlet portion has an inlet channel that extends therethrough. The outlet portion is defined by a first outlet at a first outward orientation; a second outlet at a second outward orientation, wherein the second outward orientation opposes the first outward orientation; a first outlet channel extending from a proximal end of the outlet portion to the first outlet; and a second outlet channel extending from the proximal end of the outlet portion to the second outlet, wherein the first outlet channel and the second outlet channel are in fluid communication with the inlet channel of the inlet portion of the body. During a wine pour, the wine pours out of the first outlet from the first outlet channel when the first outward orientation is downward, and wherein a continuous flow of air enters into the second outlet channel from the second outlet when the second outward orientation is upward during the wine pour of the wine.

16 Claims, 4 Drawing Sheets

(56) References Cited

U.S. PATENT DOCUMENTS

| | | | | |
|---|---|---|---|---|
| 9,896,248 | B2 * | 2/2018 | Chen | B65D 23/06 |
| 2013/0153685 | A1 * | 6/2013 | Michael J. | B01F 25/31242 222/190 |
| 2021/0094005 | A1 * | 4/2021 | Gupta | B01F 23/232 |

* cited by examiner

APPARATUS AND METHOD FOR MULTIPURPOSE WINE PREPARATION DEVICE

PRIORITY CLAIM

This application claims priority to Provisional U.S. Application, Ser. No. 63/255,582, filed on Oct. 14, 2021, entitled Apparatus and Method For Perfect Pour Wine Bottle Stopper, which is hereby incorporated by reference in its entirety for all purposes.

BACKGROUND OF THE INVENTION

Wine consumers often consume wine that is initially contained within a wine bottle. Typically, the wine bottle opening is initially secured by the wine producer using a cork or a screw cap. The wine consumers may consume wine at their home, at a food establishment such as a restaurant or bar, at a winery during a wine tasting, wine events, and/or meals after removing the initial seal from the wine bottle.

One skilled in the art appreciates that after the cork or screw cap has been removed to open the wine bottle, the wine will change its flavor characteristics due to oxidation that occurs when the wine is exposed to air. Often, allowing the wine to "breathe" during the oxidation process enhances the flavor and other characteristics of the wine. With some types of wine, an optimal breathing period of an hour or more is desirable.

When the wine bottle is left open, the breathing process may allow the wine to oxidate in the desired manner. However, leaving a wine bottle open to the ambient environment causes several problems. Namely, insects such as bees, gnats, fruit flies, and the like are potentially attracted to an opened wine bottle. If an insect enters the wine bottle, the insect may vomit or spit into the wine (since some types of these insects are only able to eat liquids). Also, an insect may excrement while on the wine bottle. Thus, having an insect on or in the wine bottle is very undesirable for health, sanitary and safety reasons. Further, insect vomit, spit and/or excrement is known to change the flavor characteristics and chemistry of the wine.

Additionally, when wine is poured from a bottle, a relatively small portion of the wine exits out of the bottle opening until backpressure builds up and causes air to enter into the bottle in an inrush manner. This repetitive process of exiting wine followed by an inrush of entering air is referred to in the arts as gurgling. Gurgling of the wine during a wine pour is undesirable because the wine in the bottle may be agitated by the gurgling process.

Further, at the end of the wine pour, some amount of wine may drip downward over the exterior surface of the wine bottle. Such inadvertent spillage results in wastage of the wine and/or may damage furniture, table coverings, clothing and other articles when the wine drips off of the bottle.

Various devices, commonly known as wine bottle stoppers, are known to be used after opening their wine bottle. The bottle stopper re-closes the opening of the wine bottle, which may be effective in preventing contamination by insects. However, such bottle stoppers may disrupt the breathing process by preventing air (with oxygen) from entering into the wine bottle.

The outlet of a pouring type bottle stopper may help the oxidation process since the outlet of the pouring type bottle stopper may allow some air to enter into the bottle. However, such pouring type bottle stoppers cannot stop the insects from accessing the wine bottle. Further, undesirable gurgling may still occur during a wine pouring using a pouring type bottle stopper.

Accordingly, there is a need in the arts for improved methods, apparatus, and systems for capping a wine bottle after it has been opened.

SUMMARY OF THE INVENTION

A system and method for a multipurpose wine preparation device to facilitate pouring a wine from a wine bottle is provided. The body of the multipurpose wine preparation device has an inlet portion and an outlet portion. The inlet portion is configured to slidably engage into an opening of the wine bottle. The inlet portion has an inlet channel that extends therethrough. The outlet portion is defined by a first outlet at a first outward orientation; a second outlet at a second outward orientation, wherein the second outward orientation opposes the first outward orientation; a first outlet channel extending from a proximal end of the outlet portion to the first outlet; and a second outlet channel extending from the proximal end of the outlet portion to the second outlet, wherein the first outlet channel and the second outlet channel are in fluid communication with the inlet channel of the inlet portion of the body. During a wine pour, the wine pours out of the first outlet from the first outlet channel when the first outward orientation is downward, and wherein a continuous flow of air enters into the second outlet channel from the second outlet when the second outward orientation is upward during the wine pour of the wine.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
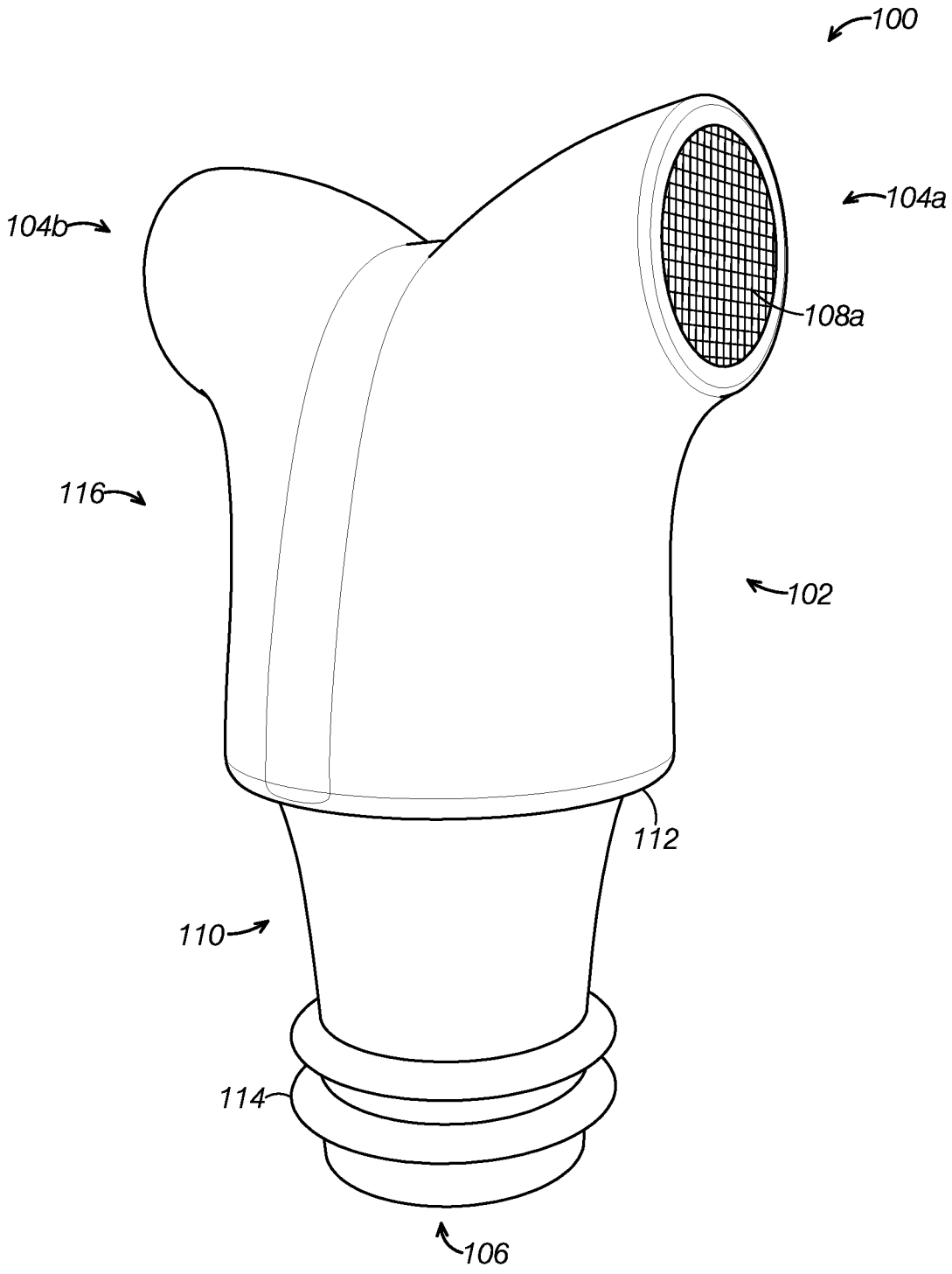
FIG. 1 is a diagram of an embodiment of the multipurpose wine preparation device.

FIG. 1 is a diagram of an embodiment of the multipurpose wine preparation device 100. Embodiments of the multipurpose wine preparation device 100 comprise a body 102, a first outlet 104*a*, a second outlet 104*b*, and an inlet 106 at a distal end of the multipurpose wine preparation device 100. A first grate 108*a* covers the first outlet 104*a* and a second grate 108*b* (not shown) covers the second outlet 104*b*.

The inlet portion 110 of the body 102 is configured to be inserted into the opening of a wine bottle (not shown). A stop rest 112, optionally encircling the body 102 proximate to the distal end of the inlet portion 110, limits the travel distance of the inlet portion 110 of the body 102 into the wine bottle.

One or more optional seal rings 114, preferably made of a flexible air and liquid impermeable material, encircle the cylindrical inlet portion 110 of the body 102. When the multipurpose wine preparation device 100 is slidably inserted (slidably engaged) into the wine bottle opening, a liquid and air tight seal is maintained between the opening of the wine bottle and the inlet portion 110 of the body 102 by the deformed seal rings 114. The deformed seal rings 114 also frictionally secure the multipurpose wine preparation device 100 to the wine bottle.

The outlet portion 116 of the body 102 extends outwardly from the opening of the wine bottle. The first outlet 104*a* and the second outlet 104*b* are located at the proximal end of the outlet portion 116 of the body 102. The first outlet 104*a* and the second outlet 104*b* are oriented in opposing directions from each other. That is, the first outlet 104*a* is at a distal end of the outlet portion 116 and is at a first outward orientation from the outlet portion 116. The second outlet 104*b* is at the distal end of the outlet portion 116 at a second outward orientation from the outlet portion 116. The second outward orientation of the second outlet 104*b* opposes (facing in an opposite, or opposing, direction) the first outward orientation of the first outlet 104*a*.

In an example embodiment, the outlet portion 116 is generally cylindrical. However, any suitable cross sectional structure may be used in alternative embodiments. For example, the outlet portion 116 might be decorative in nature, such as resembling an animal, a whimsical character equipment, a barrel, a vehicle, etc. Alternatively, or additionally, the outlet portion 116 might be functional in nature, such as by providing handles or grip members. Additionally, or alternatively, a decorative device may be secured to the top outer surface of the body 102.

The disclosed systems and methods for the multipurpose wine preparation device 100 will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods for a multipurpose wine preparation device 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

Returning to FIG. 1, the grates 108*a*, 108*b* have grate hole openings sized to permit passage of wine and air. That is, the first and second grates 108*a*, 108*b* are at least liquid permeably to permit flow of wine out of the wine bottle during a wine pour. The first and second grates 108*a*, 108*b* are also at least air permeable to permit flow of air into the wine bottle during the same wine pour.

In a preferred embodiment, the first outlet 104*a* and the second outlet 104*b* are preferably the same shape and/or size so that the user can pour wine from either the first outlet 104*a* or the second outlet 104*b*. Also, the grate holes of the grates 108*a*, 108*b* may be the same shape and/or size. In the various embodiments, the first outlet 104*a* and the second outlet 104*b* are on opposing sides of the distal end of the multipurpose wine preparation device 100. Accordingly, during a wine pour, the downward pointing one of the first outlet 104*a* or the second outlet 104*b* permit exit of the wine from the wine bottle, while the other outlet permits entry of a continuous flow of air into the wine bottle. An unexpected advantage of having identical, or near identical, outlets 104*a*, 104*b* in a preferred embodiments is that the user of the multipurpose wine preparation device 100 does not need to worry about orientation of the multipurpose wine preparation device 100 during the wine pour since the outlets 104*a*, 104*b* are on opposing sides on the distal end of the body 102 of the multipurpose wine preparation device 100. Accordingly, the user may enjoy the social aspects of the wine pour without the need for worrying about precise alignment of the multipurpose wine preparation device 100 (so that both the wine exits from the bottle concurrently with entry of the air into the wine bottle).

In the various embodiments, while the wine bottle is standing in an upright position, air can enter into and/or circulate through the bottle through the outlets 104*a*, 104*b* to facilitate the oxidation process. Further the grate holes of the grates 108*a*, 108*b* are preferably small enough to prevent, or at least deter, insects from entering into the wine bottle.

Figure 2:
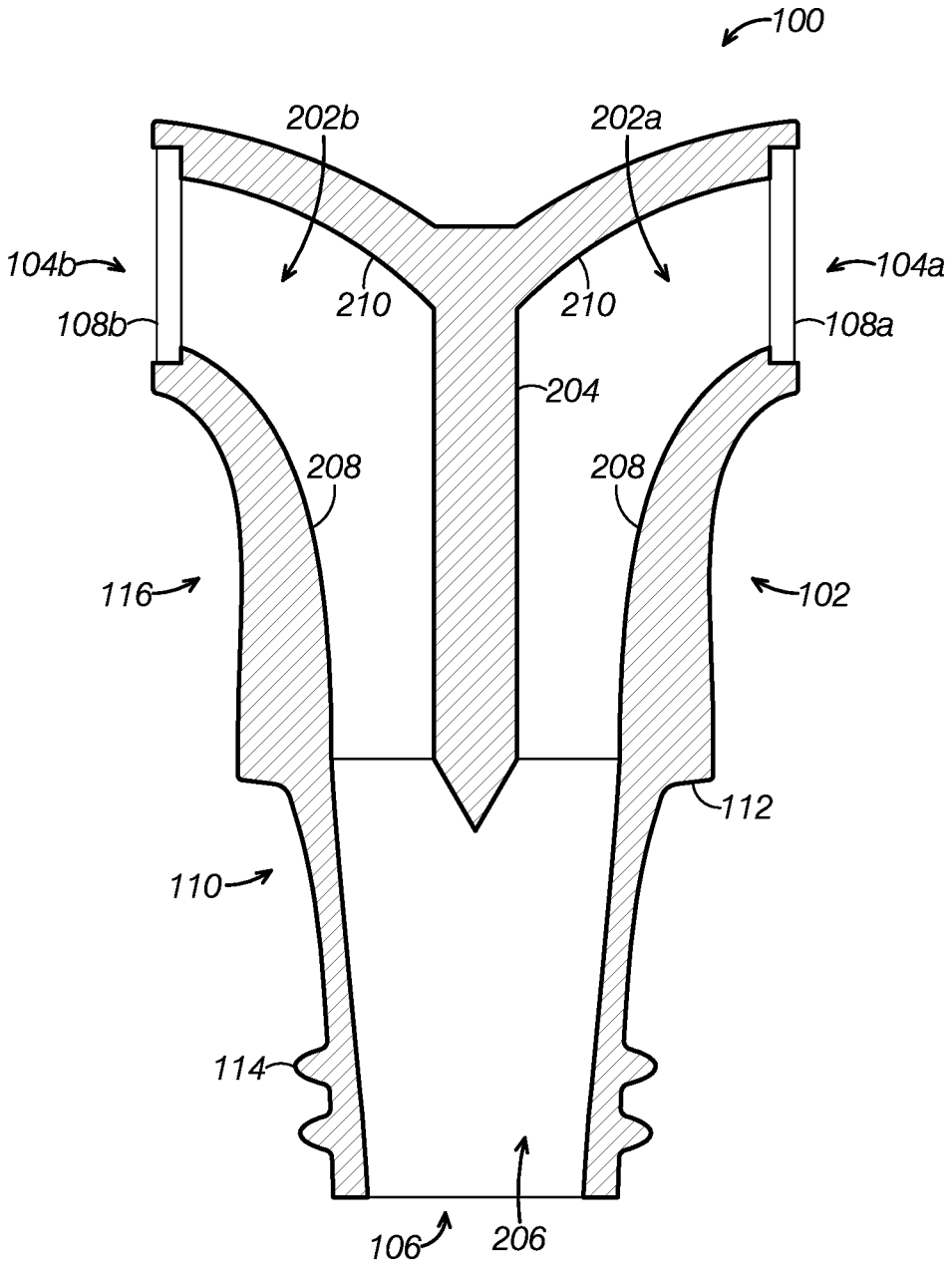
FIG. 2 is a cross section view of an example multipurpose wine preparation device.
Figure 3:
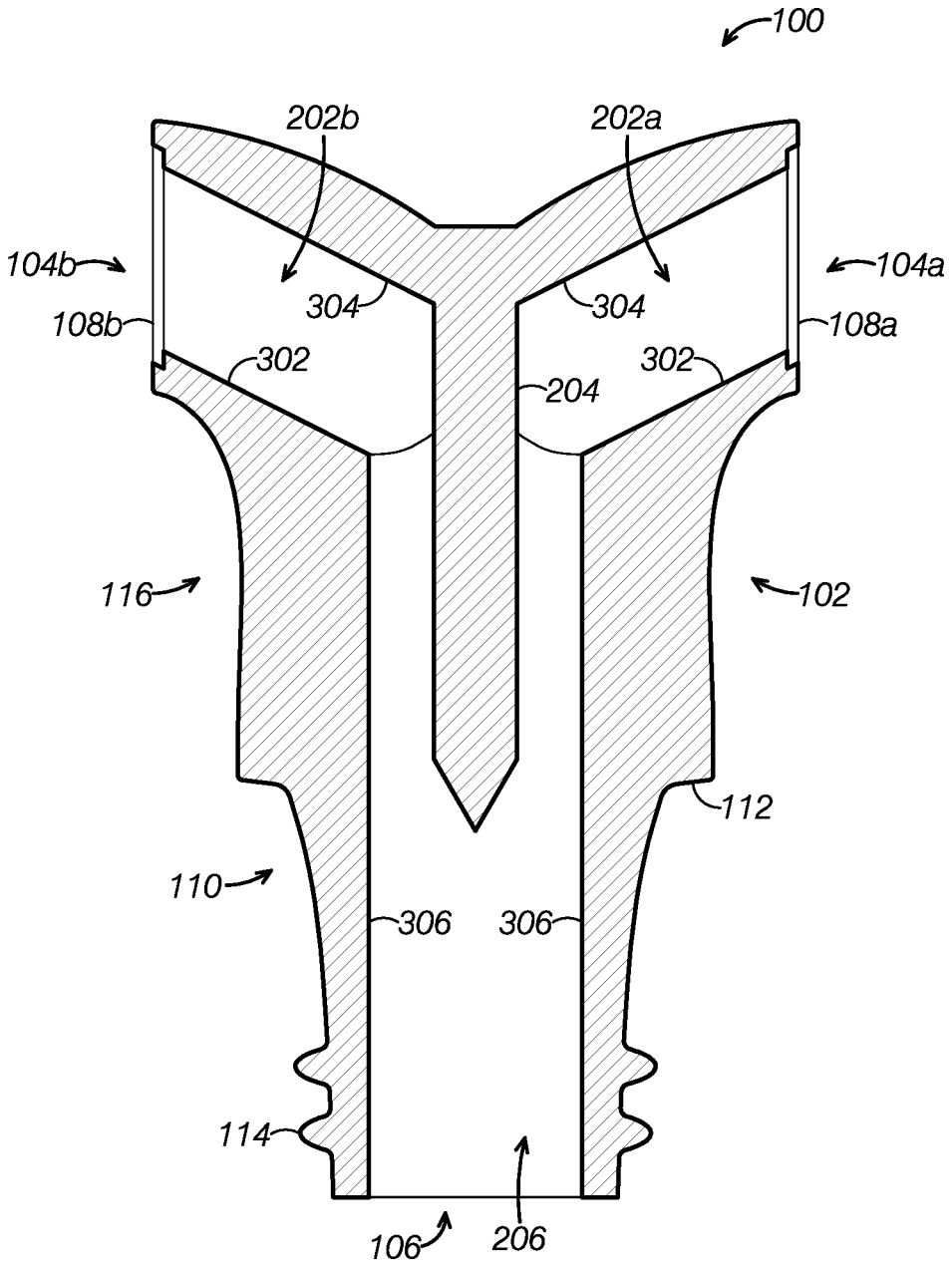
FIG. 3 is a cross section view of an alternative example multipurpose wine preparation device.

FIG. 2 is a cross section view of an example multipurpose wine preparation device 100. FIG. 3 is a cross section view of an alternative example multipurpose wine preparation device 100. Depending upon the fabrication process, one or more of the forms of the example embodiments of FIG. 2 or 3 may be used. Fabrication processes include, but are not limited to, molding, casting, three dimensional (3D) printing, or drilling a solid, or blank, body 102. Any suitable material may be used, such as a plastic, polymer, rubber, metal, wood, or the like. Preferably, the material of the body 102 is a rigid or semi-rigid material.

The interior of the outlet portion 116 of the body 102 defines a first outlet channel 202*a* and a second outlet channel 202*b*. The first grate 108*a* is secured to the distal end of the first outlet channel 202*a*. The second grate 108*b* is secured to the distal end of the second outlet channel 202*b*. The first and second grates 108*a*, 108*b* may be secured to the outlets 104*a*, 104*b* using any securing means, such as an adhesive, threads, O-ring groove channels (a shallow channel disposed on the inside surface of the outlets 104*a*, 104*b* that the edge of the first and second grates 108*a*, 108*b* flexibly fit into), or the like. In some embodiments, the first and second grates 108*a*, 108*b* may be removeable for cleaning. The grates 108*a*, 108*b* may be made of any suitable material described herein, and may be made of a different material than the body 102. The grates 108*a*, 108*b* may be rigid, semi-rigid, or flexible.

In some embodiments, the first outlet channel 202*a* is separated from the second outlet channel 202*b* by an optional barrier member 204. The example barrier member 204 is conceptually shown as a rectangular structure extending generally outwardly (downwardly in FIGS. 2 and 3) from the inside side walls 210, 304 (located within and at the distal end of the outlet portion 116) of the outlet portion 116 into the interior of the outlet portion 116 of the body 102 to separate the first outlet channel 202*a* from the second outlet channel 202*b*. In some embodiments, the end of the barrier member 204 is optionally tapered to facilitate the direction of flow of the wine during the wine pour. Any suitable structure and/or structure dimensions for the barrier member 204 may be used in the various embodiments. In some embodiments, the barrier member 204 is a separate piece that is secured into the inside interior wall 210 using a suitable securing means as described herein.

During a wine pour, the barrier member 204 separates the distal portions of the first outlet channel 202*a* from the second outlet channel 202*b*. Accordingly, during a wine pour, the barrier member 204 facilitates separating the exiting wine from the incoming air. However, if the barrier member 204 is omitted, or is relatively short in length, gravity will act to separate the exiting wine from the incoming air.

The proximal end of the first outlet channel 202*a* joins with the proximal end of the second outlet channel 202*b* to form an inlet channel 206. During a wine pour, wine enters into the inlet channel 206. Gravity directs the flow of wine through a lower portion of the inlet channel 206 to the downward directed one of the outlet channels 202*a*, 202*b*. The optional barrier member 204 further directs the flow of wine into the downward directed one of the outlet channels 202*a*, 202*b*. The wine passes through the corresponding grate 108*a*, 108*b* and exits through the corresponding downward directed outlet 104*a*, 104*b*.

As illustrated in FIG. 2, the interior side walls 208, 210 of the first outlet channel 202*a* and the second outlet channel 202*b* have a gently curving profile to facilitate a smooth pour of the wine. This embodiment of the multipurpose wine preparation device 100 would be fabricated using a mold, casting, 3D printing, or the like.

As illustrated in FIG. 3, the interior side walls 302, 304, 306 of the outlet channels 202*a*, 202*b* and the inlet channel 206 are straight. One skilled in the art appreciates that this embodiment may be fabricated by drilling out portions of a solid body 102 to form the outlet channels 202*a*, 202*b* and the inlet channel 206.

Figure 4:
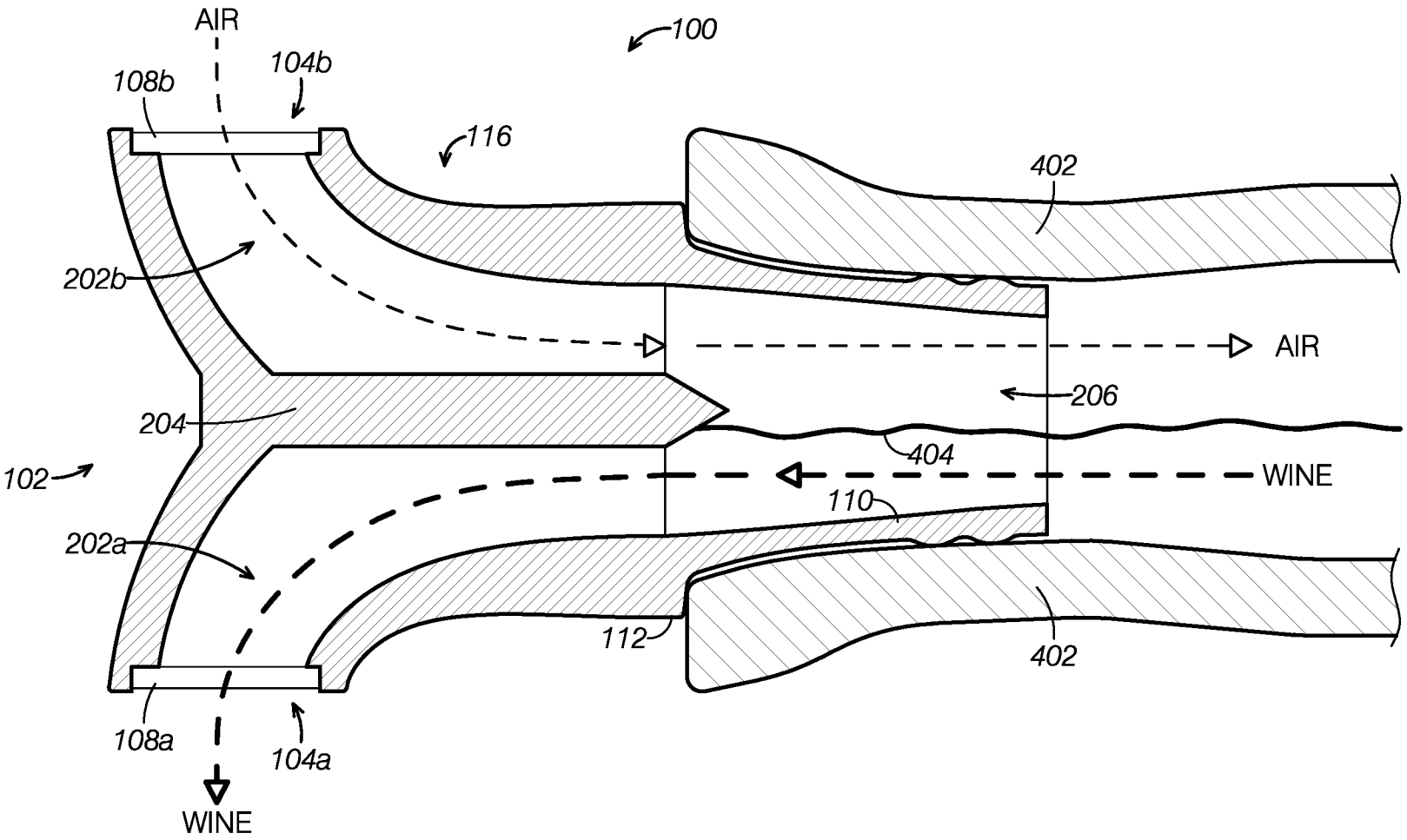
FIG. 4 is a cross section view of an example multipurpose wine preparation device showing its orientation during a wine pour.

FIG. 4 is a cross section view of an example multipurpose wine preparation device 100 showing its orientation of the multipurpose wine preparation device 100, secured into the opening of a wine bottle 402, during a wine pour.

In the conceptual example of FIG. 4, the first outlet 104*a* is pointed downward during the wine pour, preferably over a container (not shown) such as a wine glass. As the wine bottle 402 is tipped over and downward, wine begins to flow out of the wine bottle 402 and into the inlet channel 206. Gravity causes the wine to flow along the downward side of the inlet channel 206 and then into the first outlet channel 202*a*. The wine then exits through the first grate 108*a* and out of the first outlet 104*a*.

During the pour, the second outlet 104*b* is oriented upwardly so as to be above the first outlet 104*a* (because the outlets 104*a*, 104*b* are on opposing sides of the multipurpose wine preparation device 100). Gravity prevents any of the wine from exiting the upward oriented second outlet 104*b* (as conceptually illustrated by the surface 404 of the flowing wine). As the wine exits the first outlet 104*a*, a continuous stream of air flows into the second outlet 104*b* and in through the second grate 108*b*. The air continues to flow through the second outlet channel 202*b*, into the inlet channel 206, and then into the interior of the wine bottle 402 as the wine is being poured. The optional barrier 204 also facilitates separation of the incoming air and the outgoing wine.

During the wine pour, wine from the wine bottle exits the first outlet 104*a* while air concurrently enters the second outlet 104*b*. The air travels through the second outlet channel 202*a* into the inlet channel 206, wherein the air continues to travel into the wine bottle 403 from the inlet channel 206. Accordingly, a backup of an air pressure within the wine bottle 402 is prevented by the continuous flow of the air that travels into the wine bottle 402 from the inlet channel 206. With embodiments of the multipurpose wine preparation device 100, the continuous flow of the air reduces or even eliminates the undesirable gurgle effect encountered with legacy wine stoppers during a wine pour. Further, the likelihood of spillage or drippage of the wine after the conclusion of the wine pour is reduced since the gurgling has been mitigated.

The example embodiments illustrate that the first outlet 104*a* and the opposing second outlet 104*b* have the same shape, size and configuration. This similarity between the first outlet 104*a* and the second outlet 104*b* allows the user to pour wine out of either outlet 104*a*, 104*b*. In practice, the user simply (and randomly) points one of the outlets 104*a*, 104*b* in a downward direction to initiate a wine pour. The user does not need to consciously choose which one of the outlets 104*a*, 104*b* to use for pouring the wine. Accordingly, the user may enjoy the social aspects of the wine pour without the need for worrying about precise alignment of the multipurpose wine preparation device 100 (so that both the wine exits from the bottle concurrently with entry of the air into the wine bottle).

In alternative embodiments, the first outlet 104*a* and the second outlet 104*b* have different shape, size and/or configuration. Such embodiments operate in accordance with the described features of the multipurpose wine preparation device 100, and are intended to be within the scope of this disclosure and to be protected by the accompanying claims.

It should be emphasized that the above-described embodiments of the multipurpose wine preparation device 100 are merely possible examples of implementations of the invention. Many variations and modifications may be made to the above-described embodiments. All such modifications and variations are intended to be included herein within the scope of this disclosure and protected by any later filed claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

The invention claimed is:

1. A multipurpose wine preparation device to facilitate pouring a wine from a wine bottle, comprising:

a body defined by an inlet portion at a proximal end of the body and an outlet portion at a distal end of the body, wherein a proximal end of the outlet portion is joined with a distal end of the inlet portion, wherein a proximal end of the inlet portion is configured to slidably engage into an opening of the wine bottle, and wherein the inlet portion is defined by an inlet channel that extends from the proximal end of the inlet portion through the distal end of the inlet portion;

wherein the outlet portion is defined by:

a first outlet at a distal end of the outlet portion, wherein the first outlet is at a first outward orientation from the outlet portion;

a second outlet at the distal end of the outlet portion, wherein the second outlet is at a second outward orientation from the outlet portion, and wherein the second outward orientation of the second outlet opposes the first outward orientation of the first outlet;

a first outlet channel extending from a proximal end of the outlet portion to the first outlet; and a second outlet channel extending from the proximal end of the outlet portion to the second outlet, wherein the first outlet channel and the second outlet channel are in fluid communication with the inlet channel of the inlet portion of the body, wherein the wine pours out of the first outlet from the first outlet channel when the first outward orientation is downward during a wine pour of the wine, and wherein a continuous flow of air enters into the second outlet channel from the second outlet when the second outward orientation is upward during the wine pour of the wine;

a first grate disposed over the first outlet; and a second grate disposed over the second outlet.

2. The multipurpose wine preparation device of claim 1, wherein the continuous flow of air travels through the second outlet channel into the inlet channel, wherein the continuous flow of air continues to travel into the wine bottle from the inlet channel, and wherein a backup of an air pressure within the wine bottle is prevented by the continuous flow of air that travels into the wine bottle from the inlet channel.

3. The multipurpose wine preparation device of claim 1, further comprising:

a barrier member that extends outwardly from an inside side wall of the outlet portion that is located at the distal end of the outlet portion, wherein the barrier member extends into an interior of the outlet portion to separate the first outlet channel from the second outlet channel.

4. The multipurpose wine preparation device of claim 1, further comprising:

wherein the first grate is liquid permeable, wherein the second grate is air permeable, wherein a plurality of first grate holes disposed in the first grate are small enough to prevent insects from entering the wine bottle through the first outlet, and wherein a plurality of second grate holes disposed in the second grate are small enough to prevent the insects from entering the wine bottle through the second outlet.

5. The multipurpose wine preparation device of claim 1, wherein a shape of the first outlet is the same as the second outlet.

6. The multipurpose wine preparation device of claim 1, further comprising:

a stop rest located at the distal end of the inlet portion, wherein the stop rest limits a travel distance of the inlet portion of the body into the wine bottle in response to slidably inserting the proximal end of the body into a wine bottle opening.

7. The multipurpose wine preparation device of claim 1, further comprising:

at least one seal ring made of a flexible material that is air and liquid impermeable, wherein the at least one seal encircles the inlet portion of the body such that in response to slidably inserting the proximal end of the body into a wine bottle opening, a liquid and air tight seal is maintained between the wine bottle opening and the inlet portion of the body.

8. The multipurpose wine preparation device of claim 1, wherein the multipurpose wine preparation device is a three dimensional (3D) printed multipurpose wine preparation device.

9. The multipurpose wine preparation device of claim 1, wherein the first outlet channel, the second outlet channel and the inlet channel are formed by drilling a solid body member.

10. A multipurpose wine preparation device to facilitate pouring comprising:

a body defined by an inlet portion at a proximal end of the body and an outlet portion at a distal end of the body, wherein a proximal end of the outlet portion is joined with a distal end of the inlet portion, wherein a proximal end of the inlet portion is configured to slidable engage into an opening of the wine bottle, and wherein the inlet portion is defined by an inlet channel that extends from the proximal end of the inlet portion through the distal end of the inlet portion;

wherein the outlet portion is defined by:

a first outlet at a distal end of the outlet portion, wherein the first outlet is at a first outward orientation from the outlet portion, a second outlet at the distal end of the outlet portion, wherein the second outlet is at a second outward orientation from the outlet portion, and wherein the second outward orientation of the second outlet opposes the first outward orientation of the first outlet, a first outlet channel extending from a proximal end of the outlet portion to the first outlet; and a second outlet channel extending from the proximal end of the outlet portion to the second outlet, wherein the first outlet channel and the second outlet channel are in fluid communication with the inlet channel of the inlet portion of the body, wherein the wine pours out of the first outlet from the first outlet channel when the first outward orientation is downward during a wine pour of the wine, wherein a continuous flow of air enters into the second outlet channel from the second outlet when the second outward orientation is upward during the wine pour of the wine, and wherein a size of the first outlet is the same as the second outlet.

11. The multipurpose wine preparation device of claim 10, wherein the continuous flow of air travels through the second outlet channel into the inlet channel, wherein the continuous flow of air continues to travel into the wine bottle from the inlet channel, and wherein a backup of an air pressure within the wine bottle is prevented by the continuous flow of air that travels into the wine bottle from the inlet channel.

12. The multipurpose wine preparation device of claim 10, further comprising:

a barrier member that extends outwardly from an inside side wall of the outlet portion that is located at the distal end of the outlet portion, wherein the barrier member extends into an interior of the outlet portion to separate the first outlet channel from the second outlet channel.

13. The multipurpose wine preparation device of claim 10, further comprising:

a stop rest located at the distal end of the inlet portion, wherein the stop rest limits a travel distance of the inlet portion of the body into the wine bottle in response to slidably inserting the proximal end of the body into a wine bottle opening.

14. The multipurpose wine preparation device of claim 10, further comprising:

at least one seal ring made of a flexible material that is air and liquid impermeable, wherein the at least one seal encircles the inlet portion of the body such that in response to slidably inserting the proximal end of the body into a wine bottle opening, a liquid and air tight seal is maintained between the wine bottle opening and the inlet portion of the body.

15. The multipurpose wine preparation device of claim 10, wherein the multipurpose wine preparation device is a three dimensional (3D) printed multipurpose wine preparation device.

16. The multipurpose wine preparation device of claim 10, wherein the first outlet channel, the second outlet channel and the inlet channel are formed by drilling a solid body member.

* * * * *